US011897639B2

(12) United States Patent
Serpa

(10) Patent No.: US 11,897,639 B2
(45) Date of Patent: Feb. 13, 2024

(54) AUTOMATED PACKAGING APPLICATOR SYSTEM AND METHODS OF USING THE SAME

(71) Applicant: SERPA PACKAGING SOLUTIONS LLC, Visalia, CA (US)

(72) Inventor: Fernando Serpa, Visalia, CA (US)

(73) Assignee: SERPA PACKAGING SOLUTIONS LLC, Visalia, CA (US)

( * ) Notice: Subject to any disclaimer, the term of this patent is extended or adjusted under 35 U.S.C. 154(b) by 0 days.

(21) Appl. No.: 17/683,682

(22) Filed: Mar. 1, 2022

(65) Prior Publication Data

US 2022/0281628 A1 Sep. 8, 2022

Related U.S. Application Data

(60) Provisional application No. 63/155,308, filed on Mar. 2, 2021.

(51) Int. Cl.

| | |
|---|---|
| ***B65B 35/56*** | (2006.01) |
| ***B65B 17/02*** | (2006.01) |
| ***B65B 35/44*** | (2006.01) |
| ***B65B 27/04*** | (2006.01) |

(52) U.S. Cl.

CPC ..... *B65B 17/025* (2013.01); *B65B 27/04* (2013.01); *B65B 35/44* (2013.01); *B65B 35/56* (2013.01)

(58) Field of Classification Search

USPC ..... 53/398

See application file for complete search history.

(56) References Cited

U.S. PATENT DOCUMENTS

| | | | | |
|---|---|---|---|---|
| 3,742,677 | A | 7/1973 | Best | |
| 5,287,677 | A | 2/1994 | Hunter | |
| 5,791,121 | A | 8/1998 | Bernier | |
| 6,055,791 | A | 5/2000 | Odum | |
| 6,076,331 | A * | 6/2000 | Granbakken | B65B 17/025 53/398 |
| 2009/0090085 | A1 | 4/2009 | Marco | |
| 2011/0016831 | A1 | 1/2011 | Huber | |
| 2015/0090404 | A1* | 4/2015 | Van Wickeren | B65G 47/08 156/556 |
| 2018/0118484 | A1* | 5/2018 | Serpa | B65H 1/04 |
| 2018/0319521 | A1 | 11/2018 | Merrick | |
| 2019/0233145 | A1 | 8/2019 | Kooc | |
| 2022/0411114 | A1* | 12/2022 | Elliott | B65B 17/025 |
| 2023/0121478 | A1* | 4/2023 | Kooc | B65B 17/025 53/398 |

* cited by examiner

*Primary Examiner* — Chinyere J Rushing-Tucker

(74) *Attorney, Agent, or Firm* — THOMPSON HINE LLP

(57) ABSTRACT

A high-speed automated ring carrier applicator system and methods of using the same are provided. The applicator system is operable to be loaded with a magazine of ring carriers and individually apply them to a plurality of individual containers for beverages, food, pharmaceuticals, or other goods. The ring carriers may include a plurality of full or partial apertures (e.g., 2 to 12, or other numbers of apertures), each with a neck-engaging locking mechanism to receive and hold a container.

14 Claims, 10 Drawing Sheets

1201
1203a
1203b
102a
120c
120a
120
120b
150
126
126a
STEP 1

1201
1202
1206b
1206ba
1206aa
120a
120
120b
126
126a
STEP 2

1201
6710
102a
120b
120
126
STEP 3

STEP 4

STEP 5

AUTOMATED PACKAGING APPLICATOR SYSTEM AND METHODS OF USING THE SAME

TECHNICAL FIELD

The present invention relates to an insert feeding machine and related methods, and more particularly to an insert feeding machine for pharmaceutical containers, and methods of using and operating the same.

BACKGROUND

Bottles, cans, jars, and similar receptacles are often packaged together in groups of four, six, eight, etc. by a flexible by yokes having flexible ring structures that clasp the neck or rim of the containers. These yokes provide a low weight, efficient grasp and carry functionality in a very small package. However, these yokes are single use plastics that have drawbacks. They are typically made from hydrocarbon polymer materials that take a very long time to decompose. They also break down into microplastics that can disrupt ecosystems and significant harm to animal species that ingest them, such as marine species.

Recently the beverage industry, packaged food industry, and others have moved toward a new yoke design made from paper-based materials that are more environmentally friendly. An example of such carriers is the "fishbone"-style carriers are made from compostable, thin paper-based materials, and may be sealed with a water-based barrier coating for moisture resistance. Thus, the typical fishbone design quickly degrades and avoids the environmental issues of conventional plastic ring yokes. Packaging applicator systems are present in the market for such packaging operations, but they require constant observation and loading. Operators of such packaging systems must remain at the machine during operation.

Thus, there is a need for improved systems for high speed, automatic separation and application of such packaging solutions.

SUMMARY

The present invention includes packaging application system for use in connection with a process for applying carriers to cans, bottles, jars, and various other container types. The packaging application machines of the present invention have improved efficiency, automation, speed, and reliability in comparison to conventional systems. The novel features of the invention prevent long-felt problems with conventional applicator machines.

The present invention includes a high-speed automated ring carrier applicator system and methods of using the same. The applicator system is operable to be loaded with a magazine of ring carriers and individually applying them to a plurality of individual containers for beverages, food, pharmaceuticals, or other goods. The ring carriers may include a plurality of full or partial apertures (e.g., 2 to 12, or other numbers of apertures), each with a neck-engaging locking mechanism to receive and hold a container. The neck-engaging locking mechanism can include a mechanism to assist holding and retaining a container in the container carrying device, such as a clamping finger, a vertically oriented flange, a locking tab, or other mechanisms. The neck-engaging locking mechanism can be any mechanism that can hold a container in place, such as for transport via the container carrying device, when the container is inserted in a shaped opening of the container carrying device. The ring carrier may be a "fishbone"-style ring carrier, made from paper-based packaging materials, which may be biodegradable.

The ring carriers can be applied to containers by applying overhead pressure using a high-speed overhead applicator. For example, a ring carrier may be applied to a plurality of containers arranged in a pattern corresponding to apertures in the ring carrier by positive downward pressure placed on the ring carrier as it is aligned with the pre-patterned plurality of containers. The applied pressure inwardly compresses a neck-engaging locking mechanism of each aperture around the outside of each container. The containers may have caps (e.g., bottles), lids (jars), or rims (cans), and the clamping fingers/neck-engaging locking mechanisms apply a positive clamping pressure after they are advanced passed the caps, lids, or rims of the containers.

The high-speed automated ring carrier applicator system may include the following major components: an electronic controller (e.g., a PLC, a computer with microprocessor and other conventional components, etc.) for coordinating the functions of each portion of the ring carrier applicator system, a delivery conveyor, a sorting mechanism for delivering container into a grouping station, a grouping station, an applicator station at which the ring carriers are applied to the grouped containers, a ring carrier applicator operable to apply a ring carrier to an upper aspect of the grouped containers, and a ring carrier magazine from which the ring carrier applicator picks a ring carrier to apply to the containers. These components are coordinated such that the grouped containers are continually supplied to the applicator station, packaged together with a ring carrier, and are then delivered to a downstream application process at high speeds without human operator intervention.

A plurality of containers may be conveyed to a grouping station where they are organized into a pre-determined arrangement and positioned in an applicator station in which the ring carriers are applied. The containers are first transported along a conveyor from a source of the containers (e.g., from filling and sealing stations). This conveyor may be various a horizontal conveyor element, such as a feed belt, a roller bed, etc. on which the containers are moved along continuously through a packaging system to the ring carrier applicator station. The conveying system may include a funneling section of a narrowing width adjacent to the grouping station for shaping the flow of containers to a limited number of lines of containers entering the grouping station (e.g., 1, 2, 3, 4, 5, or 6 lines of containers). For example, tapering guide rails that narrow the flow of containers to two adjacent lines of containers flowing into the grouping station. In some embodiments, the conveying system may further include a container flow dividing mechanism that splits the inflow of containers into separate channels of a pre-determined width (e.g., a single container-width channels) that allow for a highly controlled flow of containers into the grouping station. The dividing mechanism may divide the flow of containers into a number of single container-width channels that matches the number of containers in one dimension of the pre-determined pattern of containers, and matching the pattern of the ring carrier. For example, where the ring carrier is configured to hold containers in a 2×3 arrangement (e.g., a sixpack), the dividing mechanism may divide the container flow into two channels to reliably deliver containers into the grouping station in two orderly channels for a 2-wide arrangement in the grouping station.

The grouping station may include a container pattern shaping assembly to arrange the containers into the pre-determined arrangement that matches the ring carrier geometry. The container pattern shaping assembly may include distal wall (e.g., having a buffer) to halt the progress of the containers delivered into the grouping station by the conveyor system, a template having a shape that accommodates one dimension of the pre-determined arrangement of containers, a template actuator, and a container feed arresting mechanism operable to prevent containers in the conveying channels from entering the grouping station. The containers are delivered into the container grouping station such that they are advance toward the distal wall, and the leading containers contact the distal wall, thereby halting the progress of the containers. The template may have a container-interfacing aspect that has multiple container nesting surfaces that are each complementary to the side of one of the containers (e.g., cylindrical side) delivered into the grouping station. For example, where the ring carrier is configured to hold containers in a 2×3 arrangement (e.g., as in a sixpack), the template may have a container-interfacing aspect with three nesting surfaces. The template may first be actuated to contact the containers once they are delivered into the grouping station by the conveying system. A template actuator may drive the template to contact one side of the side-by-side containers to shape and hold them in the pre-determined pattern in the grouping station. The template contacts one side of a first row of containers in the pattern of containers present in the grouping station. Subsequently, the template actuator may advance the patterned containers into the ring carrier applicator station located adjacent to the grouping station. Additional rows of containers may be aligned and closely packed with the first row such that the force applied to the first row by the template is transmitted to the additional rows allowing all rows in the grouping station to be transferred together into the applicator station.

The feed arresting mechanism may be positioned adjacent to the channels of the conveyor at a position just proximal to the grouping station. The feed arresting mechanism may apply pressure to the containers positioned in the conveyor just proximal to grouping station in order to arrest their progress and hold then in position outside of the grouping station. The arresting mechanism may be positioned over the channels as a clamp that moves downward over the feed channels arresting the movement of the containers from the channels into the grouping station. The arresting mechanism may be actuated by a vertical linear actuator (e.g., an electric rod linear actuator, a pneumatic linear actuator, etc.). The vertical linear actuator may be activated by a sensor that detects when the grouping station has been filled with containers. In some examples, the sensor may be an electromechanical sensor senses contact of containers with the distal wall of the grouping station (e.g., a pressure sensor). In other examples, the sensor may be an optical sensor that senses when containers arrive at the distal wall (e.g., a photoelectric sensor). Other types of sensors may also be utilized. When the sensor is triggered by the arrival of containers at the distal wall, the sensor is triggered and sends an electrical signal to activate the vertical linear actuator. The sensor may also send an electronic signal to the controller (e.g., a PLC controller, computer with microprocessor, etc.), thereby allowing the controller to monitor the activity of the container pattern shaping assembly in real time. In some embodiments, the controller may exert centralized control, with the sensor signal being sent to the controller and the controller may then send an electronic signal to activate the linear actuator in response to the sensor signal.

Once the grouping station is full of the containers, the template may be actuated to transfer the patterned container grouping into the applicator station. The template may be attached to a horizontal or substantially horizontal linear actuator (e.g., an electric rod linear actuator, a pneumatic linear actuator, etc.). The horizontal linear actuator may be activated by the controller after the arresting mechanism is deployed to stop the progress of the containers on the conveyor and prevent them from advancing as the template is actuated and pushes the containers in the grouping station into the applicator station. The movement of the containers in the grouping station may be in a different direction than the flow of containers into the grouping station. For example, and without limitation, the template may push the cans in a substantially orthogonal direction with respect to the direction of the flow of the containers from the conveyor channels. In other examples, the containers may be pushed by the template into the applicator station at an oblique angle relative to the conveyor channels.

The applicator station may have a size and shape that is substantially the same as the grouping station, and thus accommodates and holds the shaped container grouping in the arrangement that it receives from the grouping station. The applicator station may have a second template on an opposite side of the shaped container grouping from the first template. The second template may have interfacing surfaces for receiving the containers that has the same shape as the first template, enabling the second template to receive the sides of the containers and maintain their arrangement. For example, and without limitation, in the case of a 2×3 (sixpack) arrangement of cylindrical cans, the first template may have three concave cylindrical interfacing surfaces, each shaped to be complementary to the side of one of the cans in a first row of the three. The second template may similarly have three concave cylindrical interfacing surfaces, each shaped to be complementary to the side of one of the cans in a second row of the three on an opposite side of the 2×3 arrangement of cans.

When the first template is advanced toward the applicator station, and the containers are pushed into the applicator station, the containers are pinched between the first and second templates. The containers are thereby held in a static pre-determined position in the applicator station to enable the overhead application of the ring carrier. The applicator station may have an entry path between it and the grouping station. The applicator station may also have an exit path between it and a backend conveyor that transports the grouped containers to a subsequent sorting, packing, inspection, or other process after the ring carrier is applied to the grouped containers.

In some embodiments, the applicator station may include one or more additional retaining mechanisms in or around the applicator station. A retractable retaining structure (e.g., a retaining wall) may be positioned orthogonally to the first and second templates to prevent the grouped containers from advancing during the application of the ring carrier. The applicator station may also include a barrier (e.g., a wall, buffer, etc.) on the opposite side of the applicator station from the retractable retaining structure that prevents the movement of the containers from the applicator station on that side thereof. The applicator station may also include an ejection mechanism for advancing the shaped containers from the applicator station to the backend conveyor after the ring carrier is applied. In some embodiments, the ejection mechanism may be a sweeping arm that pushes the containers out of the applicator station, such as a pivoting arm or an arm traveling on a track (e.g., operated by a drive belt mechanism and servo motor). In other embodiments, the ejection mechanism may be a linear actuator that pushes the containers along the path of the backed conveyor from behind with a contact pad. The ejection mechanism may include an electromechanical actuator activated by the controller after the ring carrier applicator attaches the ring carrier to the containers in the applicator station.

The applicator may be an articulating clasping mechanism operable to (1) pick one ring carrier from a stack of ring carriers loaded in a magazine, (2) transport the picked ring carrier from the magazine to the applicator station, (3) align the ring carrier with the shaped containers in the picking station such that the holes in the ring applicator are each over the superior aspect of one of the containers, and (4) attach the ring carrier to the containers in a downward, single axis motion. The applicator may then be vertically retracted and moved back to the magazine to pick the next ring carrier therefrom.

The applicator may include applicator plate, a moveable carriage to which the applicator plate is attached, a carriage translating assembly for moving the applicator between the magazine and the applicator station, and a picking mechanism for removing a single ring carrier from the magazine against which the ring carrier is positioned prior to engaging the ring carrier with the containers. The applicator plate may have a generally planar surface and a plurality of apertures therein a pre-determined matrix arrangement that corresponds to the pre-determined grouping arrangement of the containers in the applicator station. Each aperture has an internal wall arranged such that each aperture has a shape that is complementary to the superior aspect of the containers. The apertures allow the superior aspect (e.g., a top rim of a can) to pass through the applicator plate, which engages locking tabs in the ring carrier with the outer surface of the container, thereby engaging the locking tabs with the upper aspect of the container and securing the ring carrier to the containers. For example, ring carrier may be configured to engage with a 2×3 arrangement of aluminum beverage cans (a sixpack arrangement), where the cans have a tapering neck and a flange around the top of the neck, such that the flexible tabs of the ring carrier catch on the on the flange when they are deployed as the top and neck of the can pass through the ring carrier and the corresponding apertures in the applicator plate.

The moveable carriage may be operable to pick a single ring carrier from a magazine located adjacent to or otherwise near the applicator station. The moveable carriage may include one or more grasping mechanisms for engaging the uppermost ring carrier in the magazine, allowing the carriage to the remove the uppermost ring carrier. In some embodiments, the carriage may include at least two articulating clasps or other grasping mechanisms that are each operable to pivot on an axis that is parallel to a side of the ring carrier. For example, the carriage may include two articulating jaws that are positioned on opposing sides of the applicator plate and are pivoted inferiorly away from the applicator plate such that the medial-most edges of the jaws (edge closest to the middle of the applicator plate) are spread wide enough so that the ring carrier may be passed between them. The pivoting angle may depend on the horizontal length of jaw—the longer horizontal length of the jaw, the greater the pivoting angle. The length of the horizontal aspect of each jaw may be in a range of about one inch to about 5 inches, and may vary based on the particular pre-determined arrangement of the containers. For example, for a 2×3 arrangement of containers, the horizontal aspect of each jaw may be in a range of about ½ inch to about 2.5 inches. The pivoting angle may be in a range of about 15 degrees to about 65 degrees. In some embodiments, the pivoting angle may pre-determined to be only slightly larger than the width of the ring carrier such that when the jaws are retracted toward the applicator plate, the jaws overlap with the lateral edges of the uppermost ring carrier in the magazine, which aids in efficiency of movement and in removing the uppermost ring carrier from the magazine. The jaws may be actuated by a pneumatic or electronic actuator, which may be activated by the controller. In some embodiments, the carriage may include one or more vacuum gripping mechanisms in that embedded in the applicator plate to apply a partial vacuum to the surface of the ring carrier at one or more points, thereby enabling and/or assisting with removing the uppermost ring carrier from the magazine. In some embodiments, the carriage may include finger grippers that grasp the outer edge of the ring carrier when the applicator plate is lowered into position over the uppermost ring carrier in the magazine. Other grasping mechanism for grasping the ring carriers are also contemplated within the scope of the present invention.

The carriage translating assembly for moving the carriage back and forth between the applicator station and the magazine. The carriage translating assembly may having three axes of motion and may be operable to move on a vertical axis relative to the applicator station, on a horizontal axis between the applicator station and the ring carrier magazine, and on a vertical axis over the ring carrier magazine. The carriage translating mechanism may be a four-bar mechanism with an additional a path guiding bar (e.g., a binary linkage) that defines the path of the carriage. The four-bar linkage may be driven by an oscillating shaft that drives the path of motion of the carriage translating assembly. The oscillating shaft may have laterally extending eccentric collars that are fixed to the oscillating shaft and that provide the linkage points for the four-bar linkage system. As the shaft oscillates, the carriage is lifted from one of the stations (e.g., the magazine or the applicator station) and swung to the other in an arcing motion path as the oscillating shaft spins. In other embodiments, the carriage translating assembly may include at least one actuator along each of the axes of motion of the carriage. Each of the actuators may be linear actuator (e.g., pneumatic, electronic, etc.). In some embodiments, the multiple actuators of carriage translating assembly may work in a coordinated fashion to provide the shortest or substantially shortest distance path between the applicator station and the ring carrier magazine, while still performing the vertical motion required to pick the ring carrier from the magazine and to apply the ring carrier to the grouped containers in the applicator station.

The carriage translating assembly may hold a ring carrier in alignment with and in close proximity to the applicator plate when applying the ring carrier to the grouped containers in the applicator station. The applicator plate may have a predetermined shape and the grasping mechanisms may be shaped and arranged such that they do not obstruct the apertures and the grouped containers may pass through the grasping mechanisms, the applicator plate apertures, and any other structures on the carriage allowing the ring carrier to be applied to upper portion of the containers in a swift downward motion of the carriage. The cutouts in the pivoting jaws may be present and accommodate the upper ends of the containers. Other structures in the carriage (e.g., the guide pins) may be arranged and positioned to avoid obstruction during the application of the ring carrier to the grouped containers.

During the application operation, the applicator plate and the nested ring carrier may be moved down over the grouped containers by actuation of the carriage translating assembly. The tabs of the ring carrier may be pressed onto and the apertures therein may be formed onto the upper portions (e.g., necks) of the grouped containers. In pressing and forming the ring carrier onto the upper portion of the grouped containers, frangible connections between the tabs may be broken, and the tabs may be pushed upward above the apertures in the ring carrier such that the tabs engage with upper portion of the containers above the apertures of the ring carrier. For example, the containers may be beverage cans, and the tabs may be oriented upward to engage with the underside of rim of the can such that thus automatically positioning the tabs such that they translate upward force on the ring carrier to upward force on the rim of the beverage cans, thereby lifting the cans with the carrier and preventing separation of the cans from the carrier. The pivoting jaws may open, once the ring carrier has been applied to the grouped containers, allowing the carriage and applicator plate to be retracted from the grouped containers without the pivoting jaws pulling the ring carrier upward and dislodging it from the containers. The pivoting jaw actuator(s) may be activated to open the pivoting jaws by a timing mechanism. For example, the controller may be programmed with a calibrated sequence for activating components of the carriage translating assembly and carriage, where the actuator(s) for the pivoting jaws is activated as the carriage reaches its lowest point above the applicator station—this may be based on precise timing of the motion of the carriage translating assembly. In other embodiments, the carriage may include one or more proximity or contact sensors that is activated in response to the presence of the containers when the carriage is at its lowest point above the applicator station, and may send an electronic signal directly to the actuator(s) for the pivoting jaws to activate the actuator(s), or the sensor may signal the controller of the lowermost position of the carriage, and the controller may then activate the actuator(s) for the pivoting jaws by electronic signal.

The picking operation may be facilitated by the positioning of the moveable carriage over the ring carrier magazine by the carriage translating assembly and/or by mechanisms in the ring carrier magazine. The carriage translating assembly may be calibrated to position the carriage directly over the magazine and place the applicator plate over and in alignment with the uppermost ring carrier in the magazine. The magazine may have one or more mechanisms aid in alignment of the carriage with the ring carriers in the magazine, including guide pins positioned at predefined positions on or around the applicator plate that may provide (1) provide slight repositioning of the ring carrier (e.g., less than a centimeter, such about 0.1 to about 5 mm) such that the ring carrier is in alignment with the applicator plate within a tolerance of about 0.1 mm to about 5 mm (e.g., about 0.1 mm to about 2 mm) in either the dimension of the two-dimensional surface of the applicator and with skew tolerance of about 0.1° to about 2° of skew from axial alignment with the applicator plate, and/or (2) may provide mechanical feedback to the carriage translating assembly to indicate that the carriage is out of alignment with the magazine and indicate a system error, and stop the applicator system until it can be serviced and repaired. In some embodiments, the guides may be positioned to pass through pre-defined guide points (e.g., holes) in the ring carrier to aid in aligning and maintaining the alignment of the ring carrier with the applicator plate. The guides may be guide pins (e.g., tapered guide pins) that are placed in pre-determined locations in the applicator plate that correspond to gaps between the containers in the shaped group of containers in the applicator station. For example, in the case of a 2×3 arrangement of aluminum beverage cans, there are four internal gaps between the cans through which the guide pins can pass through the ring carrier and between the cans without damaging the cans. The ring carrier may include holes having the same placement pattern as the guide pins to allow the guide pins to pass through the ring carrier and hold the ring carrier in alignment with the applicator plate.

The ring carrier magazine may be located in proximity to the applicator station (e.g., within a distance of about three inches and about 15 inches). In some embodiments, the applicator station and the magazine may be aligned laterally such that carriage translating assembly can move laterally between the applicator and magazine such that the edges of ring carriers in the magazine are aligned with the ends of grouped containers in the applicator station. In such embodiments, the carriage may be moved between the applicator station and the magazine in a linear motion that is orthogonal to the edge of the stack of ring carriers in the magazine. This arrangement allows for parsimonious, controlled movement of the carriage translating assembly between the magazine and the applicator station.

The magazine may be operable to be loaded with a plurality of ring carriers in aligned stack in a guide structure that maintains the stack of ring carriers in an aligned, ordered arrangement. The magazine may include a biasing device for pushing the stack of carriers upward to a stopping mechanism that keeps the uppermost ring carrier at a predetermined location to which the carriage translating assembly positions the applicator plate to pick the uppermost ring carrier from the magazine. The combination of the biasing device and the stopping mechanism positions the uppermost ring carrier in a reliable position that allows for the carriage to grasp and remove the uppermost ring carrier in a reliable and repeatable manner. The biasing device may be a spring-loaded feed mechanism, e.g., having one or more spring-biased push plates and/or spring-biased push rods to advance the ring carriers toward the stopping mechanism.

The stopping mechanism may be one or more retractable tab, bar, or other elongate structures (the "stopping tab") that overlap with and hold in place the uppermost ring carrier. The stopping tab may be retracted as or immediately prior to (e.g., about 10 milliseconds to about 300 milliseconds) the applicator plate contacting the uppermost ring carrier. The stopping tab may be actuated by an electromechanical device (e.g., a solenoid, a roller screw actuator, a rotating cam mechanism, etc.) in electronic communication with the controller. In some embodiments, the retraction of the stopping tab may be coordinated with the arrival of the applicator plate by mechanical timing controlled by the electronic controller. The electronic controller may then signal the electromechanical actuator of the stopping tab to retract the stopping to allow the applicator plate to remove the uppermost ring carrier. In other embodiments, the carriage may include one or more sensors for indicating the distance of the applicator plate to the uppermost ring carrier. For example, the sensor may be a proximity sensor or contact sensor located at or near the inferior surface of the applicator plate, and may be operable to activated and send a signal to the electronic controller when the applicator plate is in contact with the uppermost ring carrier. As the applicator plate is within a pre-determined distance or in contact with the uppermost ring carrier, the sensor(s) may send an electronic signal to the electronic controller, which in turn can send an electronic signal to the electromechanical actuator of the stopping tab to retract the stopping to allow the applicator plate to remove the uppermost ring carrier.

The magazine may further include failure sensors for detecting when a picking operation, an application operation applying a ring carrier to the grouped containers, and/or other operations within the system. A sensor may be positioned at or near the magazine to detect whether a ring carrier becomes improperly displaced in the magazine. For example, an optical sensor (e.g., an optical through beam sensor) may positioned over the stopping mechanism for the magazine, such that the sensor may detect a ring carrier is improperly positioned above the stopping mechanism, which indicates a picking failure by the carriage or other mechanical error. Optical sensors may also be positioned over the grouping station and/or the applicator station for determined whether each container position in the station is filled by a container. Such sensors may be optical sensors operable to detect container presence in each position. For example, one or more diffuse reflective sensors may be positioned over the grouping station and/or the applicator station, and may be triggered by the presence of containers in the station. If the there is one or more containers missing when the sensor is triggered, the sensor may send a signal to the controller, with the one or more sensors are in electronic communication, indicating that fewer than the total number of container positions are filled. The controller may then stop all operations of the system and generate an error message requiring maintenance.

Once the ring carrier has been applied to the grouped containers, the packaged grouped containers are advanced from the applicator station to a backend conveyor. This may involve one or more of the following steps: retracting the first and second templates to disengage the templates from the sidewalls of the packaged containers, removing a retractable barrier between the applicator station and the backend conveyor, and/or actuating a push rod, sweeping arm, or other pushing mechanism that applies a force on an opposite side of the packaged containers from the backend conveyor such that the pushing mechanism removes the packaged containers from the applicator station and places the packaged containers on the backend conveyor. The actuators for the templates and the retractable barrier may be activated by a timing mechanism. For example, the electronic controller may be programmed with a calibrated sequence for activating components of the applicator station, where the actuator(s) for the templates and retractable barrier are activated as the carriage reaches its lowest point above the applicator station—this may be based on precise timing of the motion of the carriage translating assembly. In other embodiments, the carriage may include one or more proximity or contact sensors that are activated in response to the presence of the containers when the carriage is at its lowest point above the applicator station, and may send an electronic signal directly to the actuator(s) for the templates and retractable barrier to activate the actuator(s), or the sensor may signal the electronic controller of the lowermost position of the carriage, and the controller may then activate the actuator(s) for the templates and retractable barrier. The ring carrier applicator system of the present invention allows for a high speed, automated loading process for delivering the containers to the grouping station, moving them into applicator station, and applying the ring carrier to the grouped container. Each of the steps of the packaging process may be closely coordinated to increase speed and efficiency. One cycle of packaging may be performed in about 1 second to about 10 seconds (e.g., about 2 seconds to about 5 seconds), which includes conveying containers into the grouping station, grouping a pre-determined arrangement of containers, moving said grouped containers into said applicator station, picking a ring carrier from said magazine, packaging said grouped containers with said ring carriers, and advancing the packaged containers to a backend conveyor.

The above-described objects, advantages and features of the invention, together with the organization and manner of operation thereof, will become apparent from the following detailed description when taken in conjunction with the accompanying drawings, wherein like elements have like numerals throughout the several drawings described herein. Further benefits and other advantages of the present invention will become readily apparent from the detailed description of the preferred embodiments.

DETAILED DESCRIPTION

Reference will now be made in detail to certain embodiments of the invention, examples of which are illustrated in the accompanying drawings. While the invention will be described in reference to these embodiments, it will be understood that they are not intended to limit the invention. To the contrary, the invention is intended to cover alternatives, modifications, and equivalents that are included within the spirit and scope of the invention. In the following disclosure, specific details are given to provide a thorough understanding of the invention. However, it will be apparent to one skilled in the art that the present invention may be practiced without all of the specific details provided.

As shown in FIGS. 1-10B, the present invention includes a high-speed automated ring carrier applicator system and methods of using the same. The applicator system is operable to be loaded with a magazine of ring carriers and individually apply them to a plurality of individual containers for beverages, food, pharmaceuticals, or other goods. The ring carrier may be a "fishbone"-style ring carrier, made from paper-based packaging materials. The high-speed automated ring carrier applicator system reliably applies ring carriers to the grouped containers of a pre-determined arrangement that matches the shape of the ring carriers.

Figure 1:
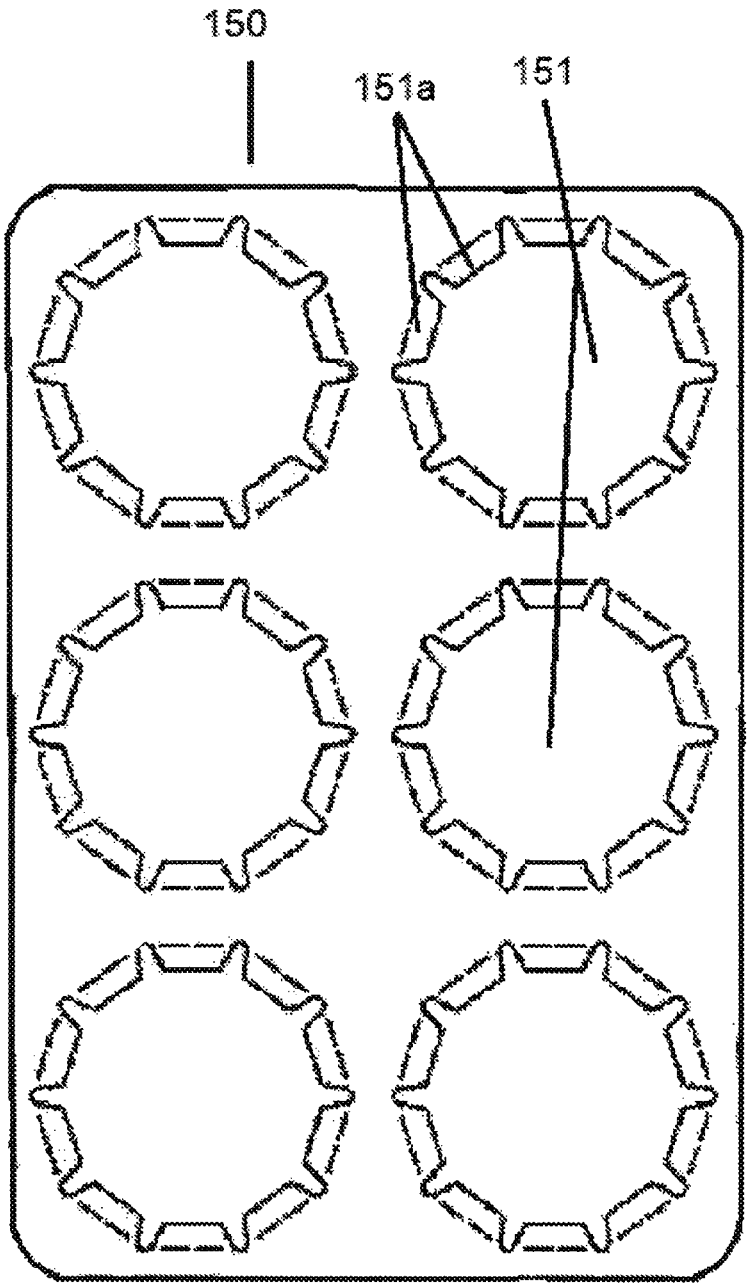
FIG. 1 shows a view of a ring carrier according to an embodiment of the present invention.

FIG. 1 shows an exemplary ring carrier 150 according to an embodiment of the present invention. The ring carriers may include a plurality of full or partial apertures 151 (e.g., 2 to 12, or other numbers of apertures), each with a neck-engaging locking mechanism to receive and hold a container. The ring carrier 150 has a 2×3 aperture arrangement (a sixpack arrangement), with apertures 151 for receiving an upper aspect of the containers. The ring carriers 150 can be applied to containers by applied overhead pressure by the presently disclosed high speed ring carrier applicator. The ring carrier 150 may include a container neck-engaging locking mechanism. The neck engaging mechanism may include locking tabs 151*a* to assist to hold and retain the containers in the ring carrier 150. The locking tabs 151*a* may be operable to hold the containers in place for transport. The ring carrier 150 may be applied to the grouped containers by positive downward pressure placed on the ring carrier 150 as it is aligned with the pre-grouped plurality of containers. The applied pressure inwardly compresses a neck-engaging locking mechanism of each aperture around the outside of each container. The locking tabs 151*a* of the ring carrier 150 may be pressed onto the containers and the apertures 151 therein may be placed around the upper portions (e.g., necks) of the grouped containers. As the ring carrier 150 is positioned over the upper portion of the grouped containers, frangible connection between the tabs 151*a* that may be broken, and the tabs 151*a* may be pushed upward above the apertures 151 in the ring carrier 150 such that the tabs engage with upper portion of the containers above the apertures 151 of the ring carrier 150. For example, the containers may be beverage cans, and the locking tabs 151*a* may be oriented upward to engage with the underside of rim of the can such that thus automatically positioning the tabs 151*a* such that they translate upward force on the ring carrier 150 to upward force on the rim of the beverage cans, thereby lifting the cans with the ring carrier 150 and preventing separation of the cans from the ring carrier 150.

Figure 2:
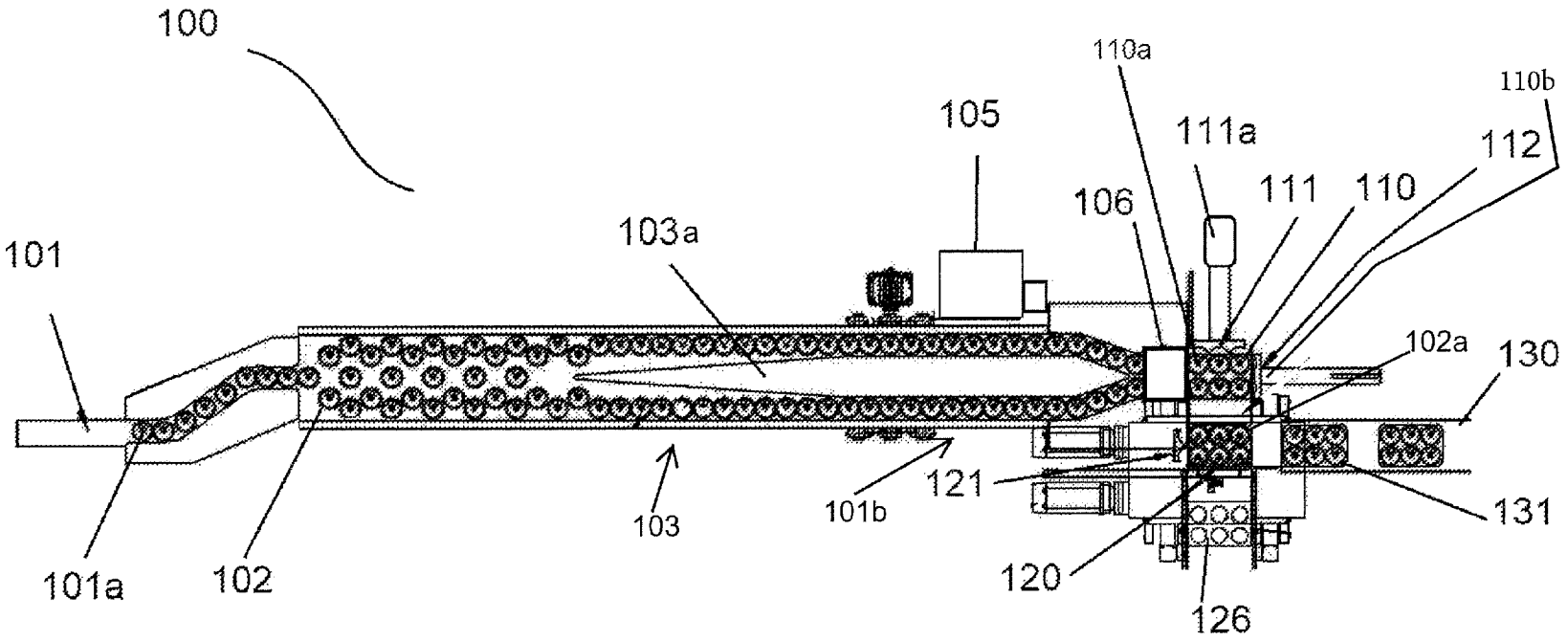
FIG. 2 shows an overhead view of an automated ring carrier application system according to an embodiment of the present invention.
Figure 3:
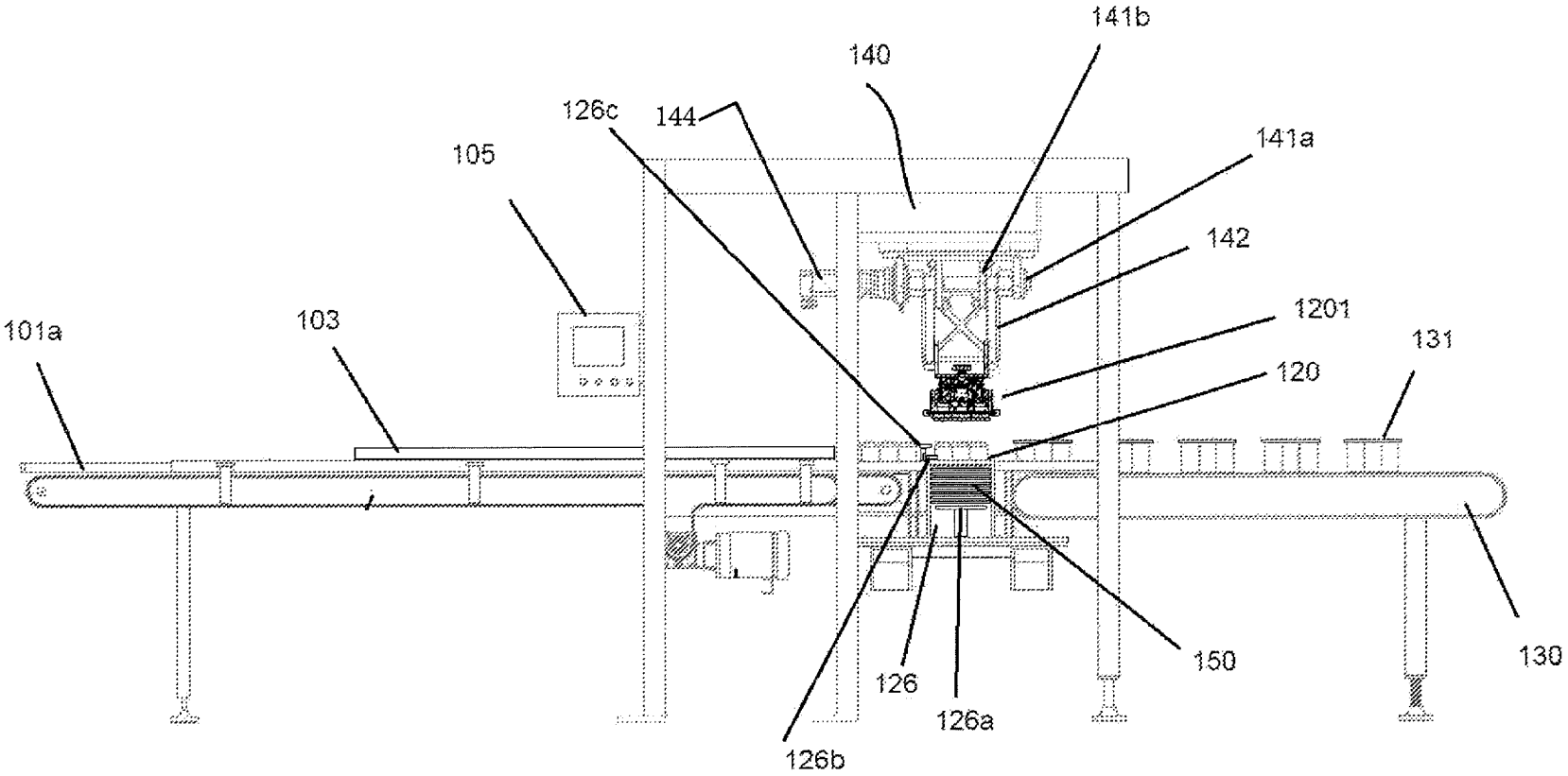
FIG. 3 shows a side view of an automated ring carrier application system according to an embodiment of the present invention.
Figure 5:
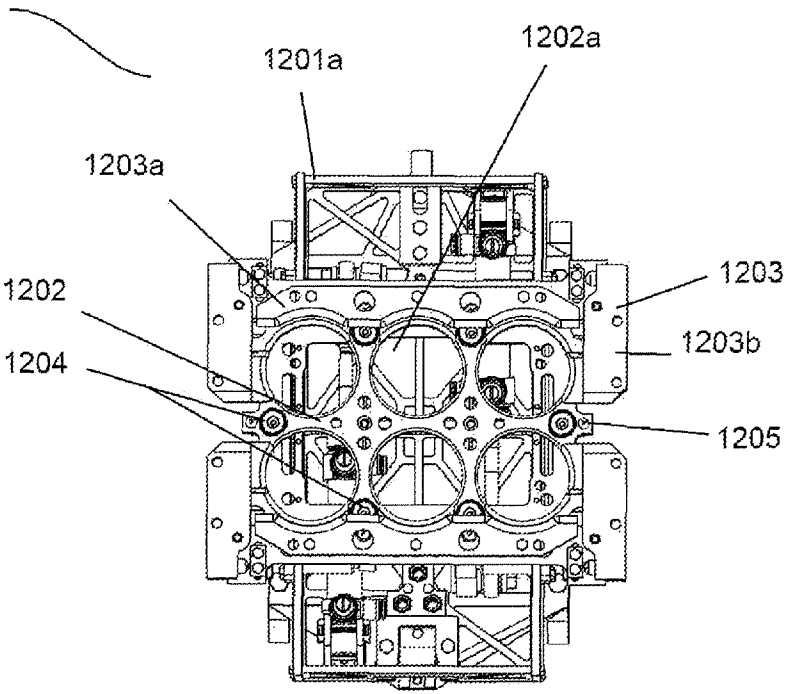
FIG. 5 shows a side view of an applicator carriage of an automated ring carrier application system according to an embodiment of the present invention.
Figure 4:
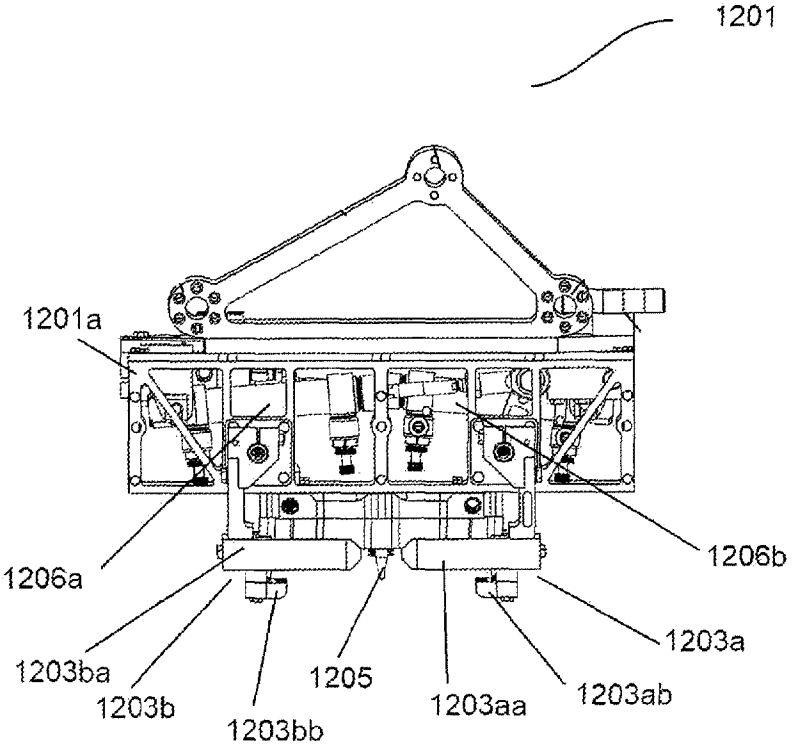
FIG. 4 shows a side view of an applicator carriage of an automated ring carrier application system according to an embodiment of the present invention.
Figure 7:
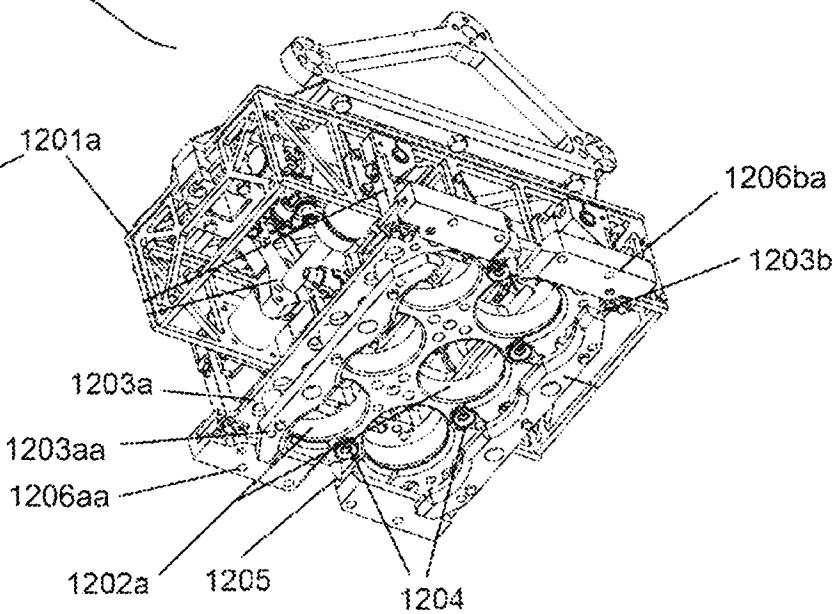
FIG. 7 shows a perspective view of an applicator carriage of an automated ring carrier application system according to an embodiment of the present invention.
Figure 6:
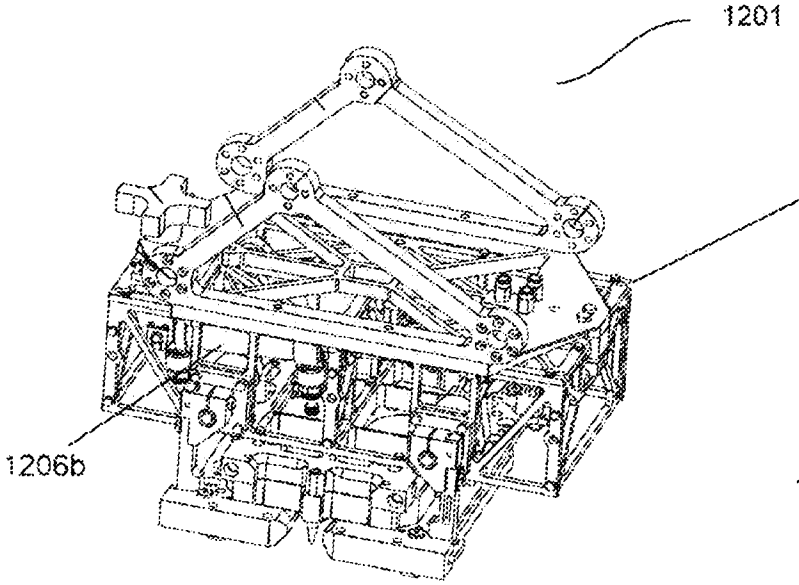
FIG. 6 shows a perspective view of an applicator carriage of an automated ring carrier application system according to an embodiment of the present invention.

FIG. 2 shows an exemplary high-speed automated ring carrier applicator system 100 according to the present invention. The system 100 may include the following major components: an electronic controller 105 (e.g., a PLC, a computer with microprocessor and other conventional components, etc.) for coordinating the functions of each portion of the ring carrier applicator system 100, a delivery conveyor 101, a sorting mechanism 103 for delivering containers into a grouping station 110, an applicator station 120 at which the ring carriers 150 are applied to the grouped containers 102*a*, a ring carrier applicator operable to apply a ring carrier to an upper aspect of the grouped containers, and a ring carrier magazine 126 from which the ring carrier applicator picks a ring carrier 150 to apply to the containers 102*a*. The feeding system also includes an electronic controller 105, which may include a microprocessor and memory, and may be connected to the electronic elements in each section of the ring carrier applicator system. The electronic controller 105 may be programmed with one or more algorithms that govern the operation of the electronic components of the ring carrier applicator system 100.

As shown in FIG. 2, feeding conveyor 101 may deliver a plurality of containers 102 to a grouping station 110, where they are organized into a pre-determined arrangement and positioned in an applicator station 120 in which the ring carriers 150 are applied. The conveyor 101 may include multiple sections and may include one or more conveyor elements, such as a feed belt, a roller bed, etc. The conveyor 101 may include an initial flow control path 101*a* (e.g., a bottleneck) that limits the number of containers 102 per unit time. The conveyor 101 may include a funneling section 101*b* of a narrowing width adjacent to the grouping station 110 for shaping the flow of containers to a limited number of lines of containers entering the grouping station (e.g., two lines of containers as shown in FIG. 2). For example, the flow divider 103*a* narrows the flow of containers to two adjacent lines of containers flowing into the grouping station 110. The divider 103*a* may divide the flow of containers 102 into two single container-width channels that matches the number of containers in one dimension of the pre-determined pattern 110*a* of containers 102 that matches the ring carrier apertures 151.

The grouping station 110 may include a container pattern shaping assembly to arrange the containers into the pre-determined arrangement that matches the ring carriers. The container pattern shaping assembly may include distal wall 112 to halt the progress of the containers 102 delivered into the grouping station 110 by the conveyor 101, a template 111 having a shape that accommodates one dimension of the pre-determined arrangement of containers 102—having nesting surfaces complementary to the sides of three adjacent containers, a template actuator 111*a*, and a container feed arresting mechanism 106. The feed arresting mechanism 106 is operable to prevent containers in the conveying channels from entering the grouping station 110. The feed arresting mechanism 106 may be positioned adjacent to the channels of the conveyor 101 at a position just proximal to the grouping station 110. The feed arresting mechanism 106 may apply pressure to the containers 102 positioned in the conveyor just proximal to grouping station 110 in order to arrest their progress and hold then in position outside of the grouping station 110. The arresting mechanism 106 may be a clamp positioned over the distal end of the conveyor 101. The arresting mechanism 106 may be operable to move downward over the containers 102 arresting the movement of the containers 102 from the conveyor 101 into the grouping station 110. The arresting mechanism 106 may be actuated by a vertical linear actuator (e.g., an electronic linear actuator, a pneumatic linear actuator, etc.). The arresting mechanism 106 may be activated by a sensor 110*b* that detects when the grouping station 110 has been filled with containers 102 (e.g., an electromechanical sensor, such as a pressure sensor, an optical sensor, etc.). When the sensor is triggered by the arrival of containers 102 at the distal wall, the sensor sends an electrical signal to activate the vertical linear actuator. The sensor may also send an electronic signal to the controller 105, thereby allowing the controller 105 to monitor the activity of the grouping station 110. In some embodiments, the sensor signal may be sent to the controller 105 and the controller 105 may then send an electronic signal to activate the linear actuator in response to the sensor signal to deploy the arresting clamp.

The containers 102 are delivered into the container grouping station 110 such that they are advanced toward the distal wall 112, and the leading containers contact the distal wall 112, thereby halting the progress of the containers 102. The template 111 may then be actuated by the controller 105 to contact the containers 102. The template actuator 111*a* may be activated by the controller 105 once the containers are delivered into the grouping station 110 to shape and hold the containers 102 in the pre-determined pattern in the grouping station 110. The template 111 only contacts one side of a first row of containers in the pattern of containers present in the grouping station 110, and the force applied to the first row of containers 102 by the template 111 is transmitted to the additional rows allowing all rows in the grouping station 110 to be transferred together into the applicator station 120.

Figures 8A, 8B, 8C:
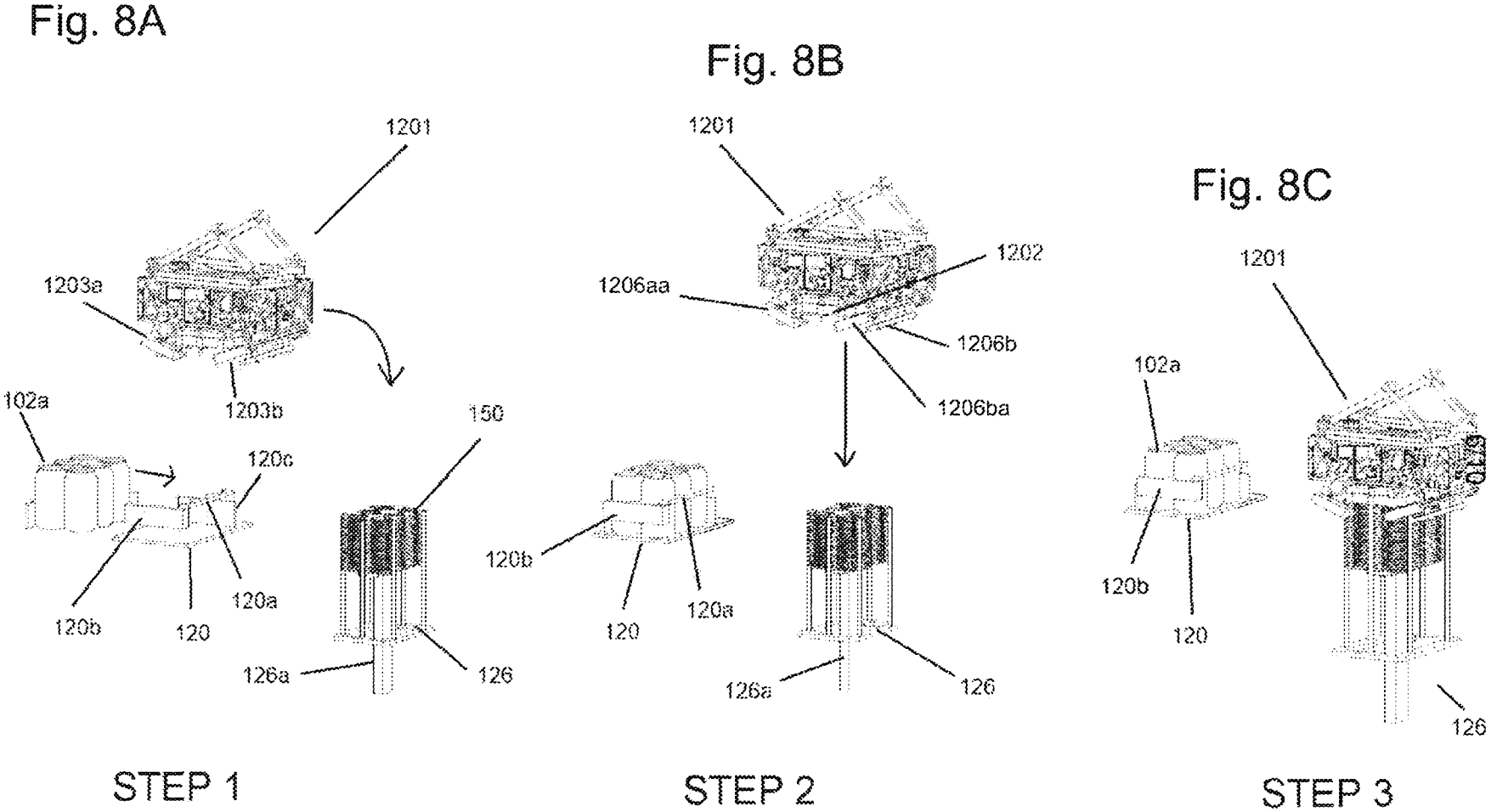
FIGS. 8A-8C shows steps 1-3 of a method of applying a ring carrier to containers using an automated ring carrier application system according to an embodiment of the present invention.
Figure 9A:
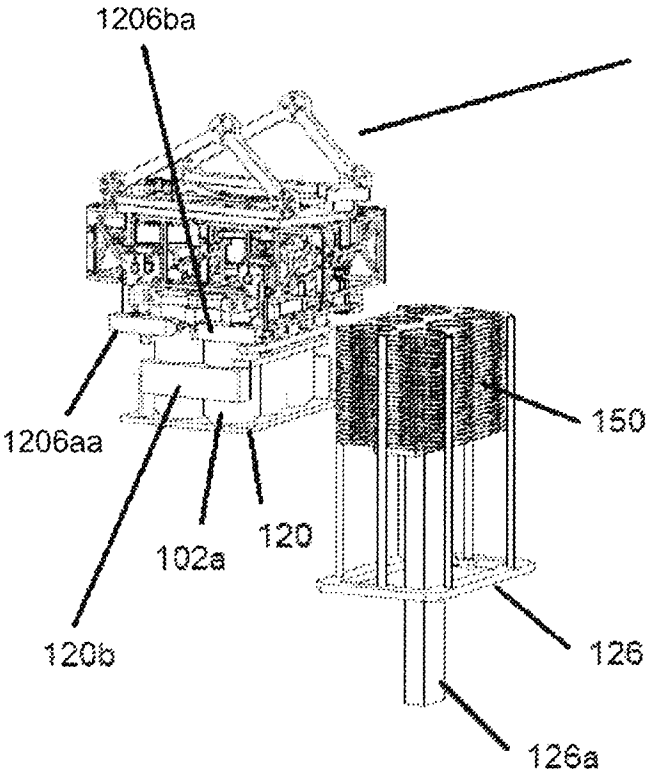
FIG. 9A-9B shows steps 4-5 of a method of applying a ring carrier to containers using an automated ring carrier application system according to an embodiment of the present invention.
Figure 9B:
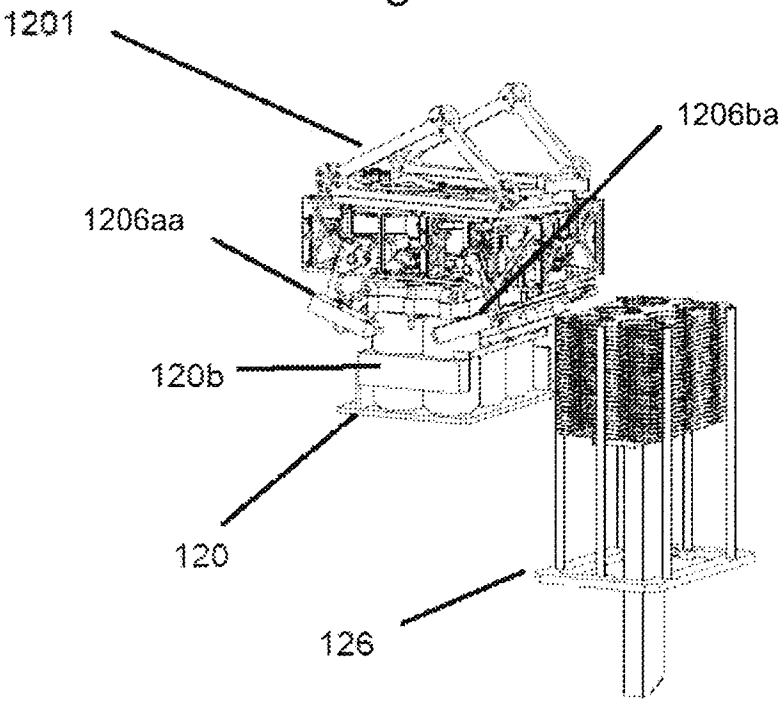
Figures 10A, 10B:
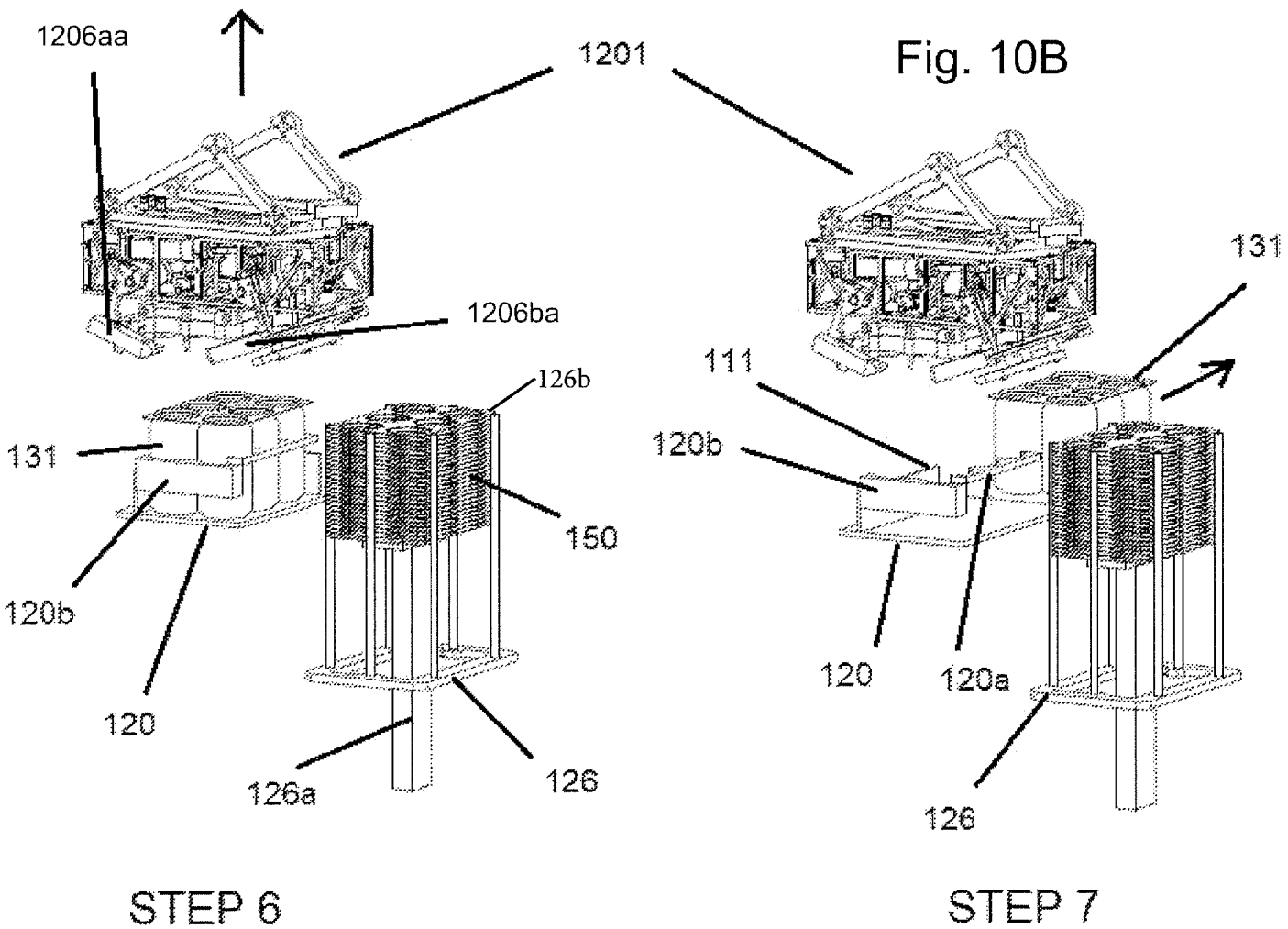
FIG. 10A-10B shows steps 6-7 of a method of applying a ring carrier to containers using an automated ring carrier application system according to an embodiment of the present invention.
Figure 11:
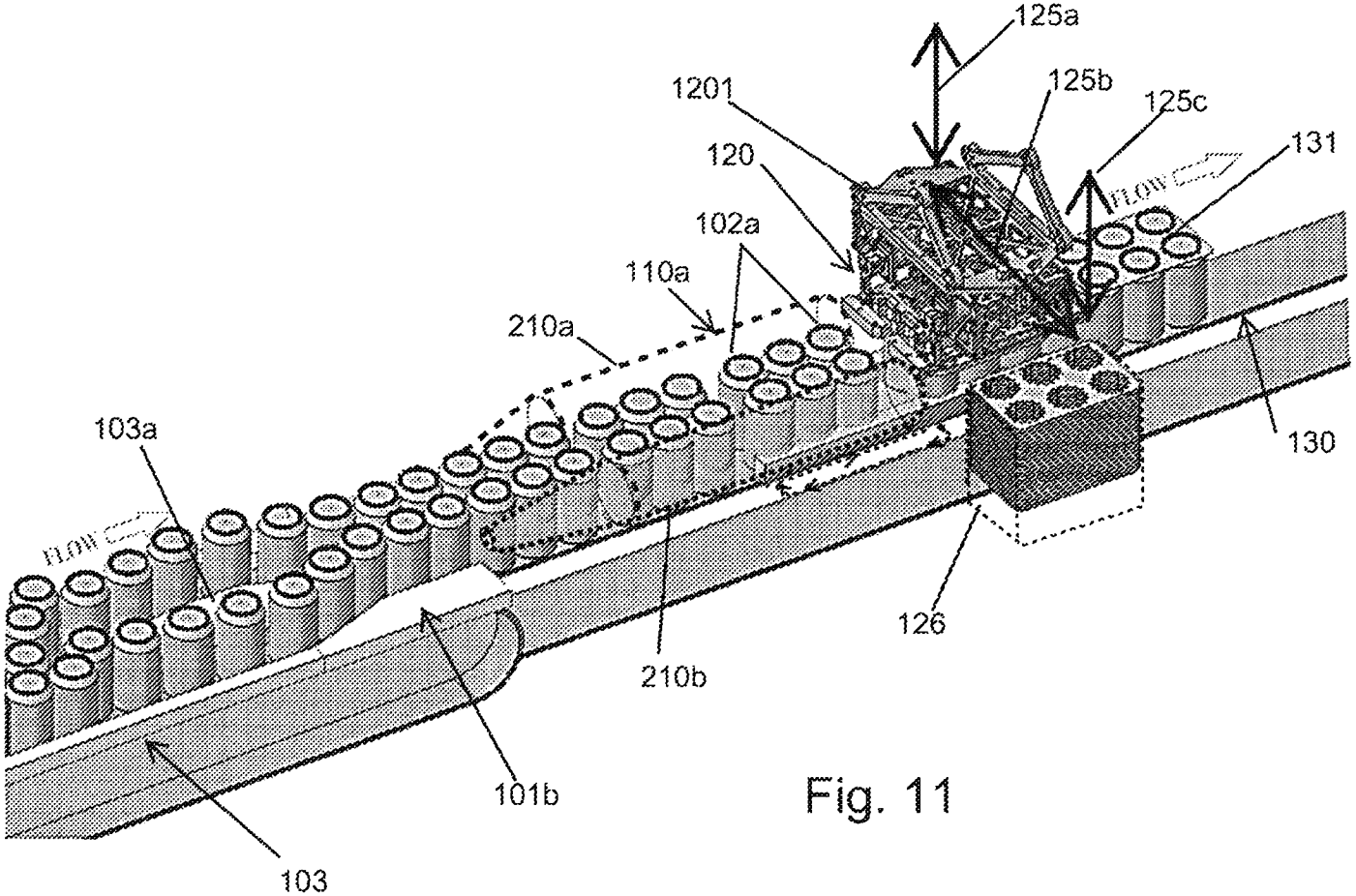
FIG. 11 show an inline embodiment of an automated ring carrier application system.
Figure 12A:
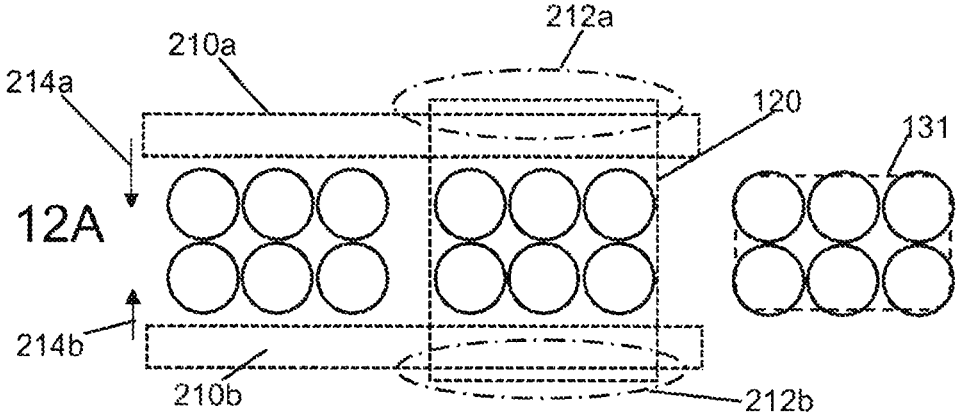
FIGS. 12A-12D show a schematic sequence of operation of the system of FIG. 11.
Figure 12B:
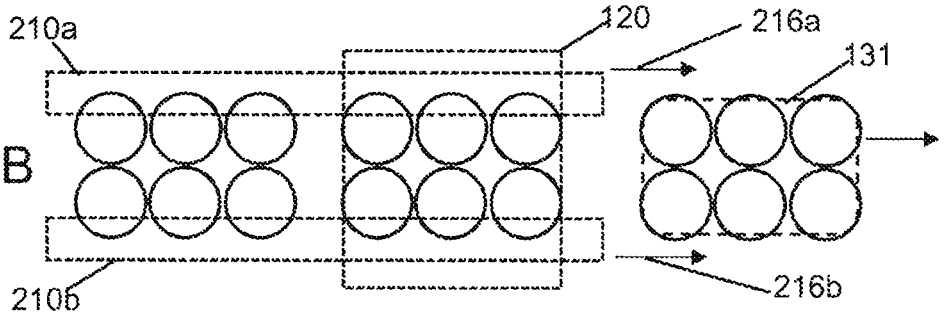
Figure 12C:
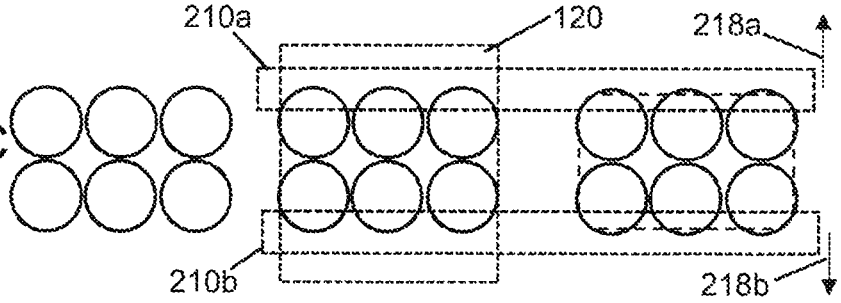
Figure 12D:
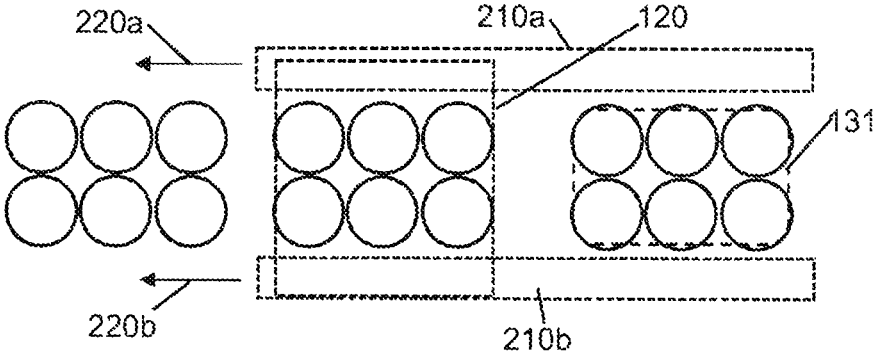

Once the grouping station 110 is full of the containers, the template 111 may be actuated to transfer the patterned container grouping 102*a* into the applicator station 120, which is shown in STEP 1 of FIG. 8A. The template 111 may be attached to a horizontal or substantially horizontal linear actuator 111*a* (e.g., an electric rod linear actuator, a pneumatic linear actuator, etc.). The horizontal linear actuator 111*a* may be activated by the controller 105, after the arresting mechanism 106 is deployed to stop the progress of the containers 102, to effect the movement of the grouped containers 102*a*. The template 111 may push the cans in a substantially orthogonal direction with respect to the direction of the flow of the containers 102 from the conveyor 101. In other examples, the containers 102 may be pushed by the template 111 into the applicator station 120 at an oblique angle relative to the conveyor 101.

The applicator station 120 may have a size and shape that is substantially the same as the grouping station 110, and thus accommodates and holds the shape of the grouped containers 102*a*. The applicator station 120 may have a second template 120*a* on an opposite side of the grouped containers 102*a* from the first template 111. The second template 120*a* may have interfacing surfaces for receiving the containers 102*a* that has the same shape as the first template 111, enabling the second template 120*a* to receive the grouped containers 102*a* and maintain their arrangement. The second template 120*a* may have three concave cylindrical interfacing surfaces, each shaped to be complementary to the side of one of the containers 102.

When the first template 111 is advanced toward the applicator station 120, and the grouped containers 102*a* are pushed into the applicator station 120, the grouped containers 102*a* are pinched between the first template 111 and the second template 120*a*. The grouped containers 102*a* are thereby held in a static pre-determined position in the applicator station 120 to enable the overhead application of a ring carrier 150. The applicator station 120 may have an entry path between it and the grouping station 110. The applicator station 120 may also have an exit path between it and a backend conveyor 130 that transports the packaged containers 131 to a subsequent sorting, packing, inspection, or other process after the ring carrier is applied to the packaged containers 131.

The applicator station 120 may include one or more additional retaining mechanisms in or around the applicator station 120. A retractable retaining structure 120*c* (e.g., a retaining wall) may be positioned orthogonally to the first template 111 and the second template 120*a* to prevent the grouped containers 102*a* from advancing during the application of the ring carrier 150. The applicator station 120 may also include a barrier 120*b* (e.g., a wall, buffer, etc.) on the opposite side of the applicator station 120 from the retractable retaining structure 120*c* that prevents the movement of the grouped containers 102*a* from the applicator station 120 on the corresponding side. The applicator station 120 may also include an ejection mechanism 121 for advancing the packaged containers 131 from the applicator station 120 to the backend conveyor 130 after the ring carrier 150 is applied thereto. The ejection mechanism 121 may be a sweeping arm that pushes the packaged containers 131 out of the applicator station 120, such as a pivoting arm or an arm traveling on a track (e.g., operated by a drive belt mechanism and servo motor). In other embodiments, the ejection mechanism 121 may be a linear actuator that pushes the containers along the path of the backed conveyor from behind with a contact pad. The ejection mechanism 121 may include an electromechanical actuator activated by the controller 105 after the ring carrier applicator 1201 attaches the ring carrier 150 to the grouped containers 102*a*.

The applicator 1201 may be an articulating clasping mechanism operable to (1) pick one ring carrier 150 from a stack of ring carriers loaded in a magazine 126, (2) transport the picked ring carrier 150 from the magazine 126 to the applicator station 120, (3) align the ring carrier 150 with the grouped containers 102*a* in the applicator station 120 such that the apertures 151 in the ring applicator 150 are each over the superior aspect of one of the containers 120, and (4) attach the ring carrier 150 to the grouped containers 102*a* in a downward, single axis motion. The applicator 1201 may then be vertically retracted and moved back to the magazine 126 to pick the next ring carrier 150 therefrom.

The applicator may include a moveable carriage 1201*a* and an applicator plate 1202, and a carriage translating assembly 140 for moving the applicator 1201 between the magazine 126 and the applicator station 120, and a picking mechanism for removing a single ring carrier 150 from the magazine 126 against which the ring carrier 150 is positioned prior to engaging the ring carrier 150 with the grouped containers 102*a*. The applicator plate 1202 may have a generally planar body and a plurality of apertures 1202*a* in a pre-determined matrix arrangement that correspond to the pre-determined grouping arrangement of the containers in the applicator station 120. Each aperture 1202*a* has a series of internal walls arranged such that each aperture 1202*a* has a shape that is complementary to the superior aspect of the containers 102. The apertures 1202*a* allow the superior aspect (e.g., a top rim of a can) to pass through the applicator plate 1202, which engages locking tabs 151*a* in the ring carrier 150 with the outer surface of the container 102, thereby engaging the locking tabs 151*a* with the upper aspect of the container 102 and securing the ring carrier 150 to the containers 102.

The moveable carriage 1201 may be operable to pick a single ring carrier 150 from a magazine 126 located adjacent to or otherwise near the applicator station 120. The moveable carriage 1201 may include one or more grasping mechanisms 1203 for engaging the uppermost ring carrier 150 in the magazine 126, allowing the carriage 1201 to the remove the uppermost ring carrier 150. The carriage 1201 may include a pair of articulating jaws 1203*a* and 1203*b* that are each operable to pivot on an axis that is parallel to a side of the applicator plate 1202. The two articulating jaws 1203*a*, 1203*b* may be positioned on opposing sides of the applicator plate 1202 and may be pivoted inferiorly away from the applicator plate 1202 such that the medial-most edges of the jaws (edge closest to the middle of the applicator plate 1202) are spread wide enough so that the ring carrier 150 may be passed between them. The jaws may be actuated by a pneumatic, hydraulic, or electronic actuator 1203*aa*, 1203*bb* activated by the controller 105. Actuator 1206*a* may be in mechanical communication with articulating jaw 1203*a* via mechanical linkage 1206*aa*, and actuator 1206*b* may be in mechanical communication with jaw 1203*b* via mechanical linkage 1206*ba*. The pivoting jaw actuator 1206*a*, 1206*b* may be activated to open the pivoting jaws 1203*a*, 1203*b* by a timing mechanism. For example, the controller 105 may be programmed with a calibrated sequence for activating components of the carriage translating assembly 140 and carriage 1201, where the actuator(s) 1206*a*, 1206*b* for the pivoting jaws 1203*a*, 1203*b* is activated as the carriage 1201 reaches its lowest point above the applicator station 120—this may be based on precise timing of the motion of the carriage translating assembly 140. In other embodiments, the carriage 1201 may include one or more proximity or contact sensors that is activated in response to the presence of the grouped containers 120*a* when the carriage 1201 is at its lowest point above the applicator station 120, and may send an electronic activation signal directly to the actuator(s) 1206*a*, 1206*b*, or the sensor may signal the controller 105 of the lowermost position of the carriage 1201, and the controller 105 may then activate the actuator(s) 1206*a*, 1206*b* to open pivoting jaws 1203*a*, 1203*b*.

In some embodiments, the carriage 1201 may further include one or more vacuum gripping mechanisms 1204 embedded in the applicator plate 1202 to apply a partial vacuum to the surface of the ring carrier 150 at one or more points, thereby enabling and/or assisting with removing the uppermost ring carrier 150 from the magazine 126. The carriage 1201 may also include guide pins 1205 (e.g., tapered guide pins) positioned at predefined positions on or around the applicator plate 1202 that may provide (1) slight repositioning of the ring carrier (e.g., less than a centimeter, such about 0.1 to about 5 mm) such that the ring carrier 150 picked from the magazine 126 is in alignment with the applicator plate 1202 within a tolerance of about 0.1 mm to about 5 mm (e.g., about 0.1 mm to about 2 mm) in either the dimension of the two-dimensional surface of the applicator plate 1202 and with skew tolerance of about 0.1° to about 2° of skew from axial alignment with the applicator plate, and/or (2) mechanical feedback to the carriage translating assembly 140 to indicate that the carriage 1201 is out of alignment with the magazine 126 and indicate a system error, and stop the applicator system 100 until it can be serviced and repaired.

The carriage translating assembly 140 moves the carriage 1201 back and forth between the applicator station 120 and the magazine 126. The carriage translating assembly 140 may having three axes of motion and may be operable to move on a vertical axis relative to the applicator station 120, on a horizontal axis between the applicator station 120 and the ring carrier magazine 126, and on a vertical axis over the ring carrier magazine 126. The carriage translating mechanism 140 may be a four-bar mechanism 142 with an additional path guiding bar (e.g., a binary linkage) that defines the path of the carriage. The four-bar linkage 142 may be in mechanical communication with an oscillating shaft 141*a* driven by an electrical motor 144 (e.g., a stepper motor, a servo, etc.) that rotates the oscillating shaft 141*a* in both rotational directions in a predetermined pattern that precisely translates the carriage 1201 from the applicator station 120 and the ring carrier magazine 126. The oscillating shaft 141*a* may have laterally extending collars 141*b* that are fixed to the oscillating shaft 141*a* and that provide the linkage points for the four-bar linkage system 142. As the shaft 141*a* oscillates, the carriage 1201 is lifted from one of the stations (e.g., the magazine or the applicator station) and swung to the other as the oscillating shaft 141*a* spins.

The carriage translating assembly 140 may hold a ring carrier 150 in alignment with and in close proximity to the applicator plate 1202 when applying the ring carrier 150 to the grouped containers 102*a* in the applicator station 120. The applicator plate 1202 may have a predetermined shape and the grasping mechanisms 1203 may be shaped and arranged such that the grouped containers 102*a* may pass through the grasping mechanisms 1203, the applicator plate apertures 1202*a*, and any other structures on the carriage 1201 such that the ring carrier 150 may be applied to upper portion of the grouped containers 102*a* in a swift downward motion of the carriage 1201 without any obstruction. The cutouts 1203*aa* in the pivoting jaws 1203*a* and 1203*b* may be present and accommodate the upper ends of the containers 102*a*. Other structures in the carriage 1201, including the guide pins 1205 may be arranged and positioned to avoid obstruction during the application of the ring carrier 150 to the grouped containers 102*a*.

During the application operation, the applicator plate 1202 and the nested ring carrier 150 may be moved down over the grouped containers 102*a* by actuation of the carriage translating assembly 140. The tabs 151*a* of the ring carrier 150 may be pressed onto and the apertures 151 therein may be positioned around the upper portions (e.g., necks) of the grouped containers 102*a*. In pressing and forming the ring carrier 150 onto the upper portion of the grouped containers, and the locking tabs 151*a* may be pushed upward above the apertures in the ring carrier 150 such that the tabs 151*a* engage with upper portion of the containers 102*a* above the apertures 1202*a* of the ring carrier 150. The pivoting jaws 1203*a*, 1203*b* may open, once the ring carrier 150 has been applied to the grouped containers 102*a*, allowing the carriage 1201 and applicator plate 1202 to be retracted from the now packaged containers 131 without the pivoting jaws 1203*a*, 1203*b* pulling the ring carrier 150 upward.

The picking operation may be facilitated by the positioning of the moveable carriage 1201 over the ring carrier magazine 126 by the carriage translating assembly 140 and/or by mechanisms in the ring carrier magazine 126. The carriage translating assembly 140 may be calibrated to position the carriage 1201 directly over the magazine 126 and place the applicator plate 1202 over and in alignment with the uppermost ring carrier 150 in the magazine 126. The ring carrier magazine 150 may be located in proximity to the applicator station 120 (e.g., within a distance of about three inches and about 15 inches). In some embodiments, the applicator station 120 and the magazine 126 may be aligned laterally such that carriage translating assembly 140 can move laterally between the applicator 120 and magazine 126 such that the edges of ring carriers 150 in the magazine 126 are aligned with the ends of grouped containers 102*a* in the applicator station 120. In such embodiments, the carriage may be moved between the applicator station 120 and the magazine 126 in a linear motion that is orthogonal to the edge of the stack of ring carriers 150 in the magazine 126.

The magazine 126 may be operable to be loaded with a plurality of ring carriers 150 in aligned stack in a guide structure that maintains the stack of ring carriers in an aligned, ordered arrangement. The magazine 126 may include a biasing device 126*a* for pushing the stack of carriers 150 upward to a stopping mechanism 126*b* (e.g., a catch that overlaps with one or more edges of the uppermost ring carrier 150) that keeps the uppermost ring carrier 150 at a pre-determined location to which the carriage translating assembly 140 positions the applicator plate 1202 to pick the uppermost ring carrier 150 from the magazine 126. The combination of the biasing device 126*a* and the stopping mechanism 126*b* positions the uppermost ring carrier 150 in a reliable position that allows the uppermost ring carrier 150 to be removed in a reliable and repeatable manner. The biasing device 126*a* may be a spring-loaded feed mechanism, e.g., having one or more spring-biased push plates and/or spring-biased push rods to advance the ring carriers toward the stopping mechanism. The stopping mechanism 126*b* may be a retractable arm that extends over the stack of ring carriers 150 in between picking operations. For example, the stopping mechanism 126*b* may be one or more retractable tab, bar, or other elongate structures (the "stopping tab") that overlap with and hold in place the uppermost ring carrier 150. The stopping tab may be retracted as or immediately prior to (e.g., about 10 milliseconds to about 300 milliseconds) the applicator plate 1202 contacting the uppermost ring carrier 150. The stopping tab may be actuated by a linear actuator (e.g., a solenoid, a roller screw actuator, a rotating cam mechanism, etc.) or rotational actuator (e.g., a pivoting arm or an arm traveling on a track operated by a drive belt mechanism, a stepper motor, servo motor, or other) in electronic communication with the controller 150. In some embodiments, the retraction of the stopping tab may be coordinated with the arrival of the applicator plate by mechanical timing controlled by the electronic controller. The electronic controller may then signal the electromechanical actuator of the stopping tab to retract the stopping to allow the applicator plate to remove the uppermost ring carrier. In other embodiments, the carriage may include one or more sensors for indicating the distance of the applicator plate to the uppermost ring carrier. For example, the sensor may be a proximity sensor or contact sensor located at or near the inferior surface of the applicator plate, and may be operable to activated and send a signal to the electronic controller when the applicator plate is in contact with the uppermost ring carrier. As the applicator plate is within a pre-determined distance or in contact with the uppermost ring carrier, the sensor(s) may send an electronic signal to the electronic controller, which in turn can send an electronic signal to the electromechanical actuator of the stopping tab to retract the stopping tab to allow the applicator plate to remove the uppermost ring carrier from engagement with the ring carriers 150 when the carriage 1201 is positioned over the ring carrier magazine 126.

The magazine 126 may further include one or more failure sensors 126*c* positioned at or near the magazine to detect whether a ring carrier 150 becomes improperly displaced in the magazine 126. For example, an optical sensor (e.g., an optical through beam sensor) may positioned over the stopping mechanism 126*b*, such that the sensor may detect if a ring carrier 150 is improperly positioned above the stopping mechanism 126*b*, which indicates a picking failure by the carriage 1201 or other mechanical error.

Once the ring carrier 150 has been applied to the grouped containers 102*a*, the packaged containers 131 are advanced from the applicator station to a backend conveyor 130. This may involve one or more of the following steps: retracting the first template 111 and second template 120*a* to disengage the templates from the sidewalls of the packaged containers 131, removing a retractable barrier 120*c* between the applicator station 120 and the backend conveyor 130, and/or actuating the ejection mechanism 121 that applies a force on an opposite side of the packaged containers 131 from the backend conveyor 130 such that the ejection mechanism 121 removes the packaged containers 131 from the applicator station 120 and places them on the backend conveyor 130. The actuators for the templates and the retractable barrier may be activated by a timing mechanism. For example, the controller 105 may be programmed with a calibrated sequence for activating components of the applicator station 120, where the actuator(s) 1206*a* and 1206*b* for the templates and an actuator for the retractable barrier 120*c* are activated as the carriage 1201 reaches its lowest point above the applicator station 120—this may be based on precise timing of the motion of the carriage translating assembly 140. In other embodiments, the carriage 1201 may include one or more proximity or contact sensors that is activated in response to the presence of the grouped containers 120*a* when the carriage 1201 is at its lowest point above the applicator station 120, and may send an electronic signal directly to the actuator(s) for the templates and retractable barrier to activate the actuator(s), or the sensor may signal the controller 105 of the lowermost position of the carriage 1201, and the controller 105 may then activate the actuator(s) for the templates and retractable barrier.

Referring now to FIGS. 11 and 12A-12D, an alternative embodiment of a system 100' is shown, in which the applicator station 120 is in-line with the conveyor, where the conveyor may have an infeed configuration comparable to that described above, including a funneling section 101*b* and divider 103*a* to create two converging rows of containers 102. The label applicator 1201 may be controlled for movement between the applicator station 120 and the ring carrier magazine 126 by a carriage translating assembly as described above (e.g., assembly 140 above), with such movement represented by arrows 125*a*, 125*b* and 125*c*.

Here, feed screw mechanisms 210*a* and 210*b* are located at opposite sides of the container conveyance path and are synchronized with each other (e.g., driven by a common drive or driven by servomotors that are synced) to group the containers into sets of grouped containers 102*a* of the desired number and orientation, immediately upstream of the applicator station 120. Thus, the downstream portion of the feed screws defines a grouping station 110' of the system. The rotation of the feed screws 210*a* and 210*b* can be controlled to hold groups of containers in ready position upstream of the applicator station 120, and thus the feed screws operate also as a container feed arresting mechanism.

Template rails 212*a* and 212*b* are located on opposite sides of the conveyance path and have a conveyance path facing configuration to match two sets of the grouped containers, with a shape that accommodates one dimension of the pre-determined arrangements of containers (e.g., here having nesting surfaces complementary to the sides of three adjacent containers of one group and three adjacent containers of the following group). The template rails 210*a* and 210*b* are movable by synchronized actuators (e.g., represented 212*a* and 212*b*) so as to repeatedly, (i) move laterally inward to engage with a grouped set of containers at the applicator station 120 and a grouped set of containers immediately upstream of the applicator station, per arrows 214*a*, 214*b* and the transition from FIG. 12A to FIG. 12B, (ii) hold the two groupings stationary (in the position of FIG. 12B) while a carrier is applied to the container group at the applicator station 120 to form a packaged grouping 131, (iii) move the packaged grouping 131 out of the applicator station to the backend conveyor 130 (which, here, is formed by a continuation of the main conveyor) while moving the next container grouping into the applicator station, per arrows 216*a* and 216*b* and the transition from FIG. 12B to FIG. 12C (iv) disengage from all containers by moving laterally outward, per arrows 218*a* and 218*b* and the transition from FIG. 12C to FIG. 12D and (v) move back upstream, per arrows 220*a* and 220*b*, to return to the position of FIG. 12A for another cycle.

It is to be understood that variations and modifications of the present invention may be made without departing from the scope thereof. It is to be appreciated that the features disclosed herein may be used different combinations and permutations with each other, all falling within the scope of the present invention.

The foregoing descriptions of specific embodiments of the present invention have been presented for purposes of illustration and description. They are not intended to be exhaustive or to limit the invention to the precise forms disclosed, and many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated.

What is claimed is:

1. A system for applied packaging to grouped containers, comprising:

a grouping station for organizing a plurality of containers into a pre-determined arrangement;

an applicator station for receiving said plurality of containers in said pre-determined arrangement;

an applicator carriage having an applicator surface for receiving a ring carrier, said applicator surface having apertures for receiving an upper aspect of each of said containers in said predetermined arrangement, pivoting retainer structures for holding said ring carrier in alignment with said applicator surface, the applicator carriage operable to fixedly apply said ring carrier to said upper aspects of said containers by a single axis vertical motion;

a magazine operable to contain a plurality of ring carriers in a vertical stack, said magazine positioned adjacent to said applicator station, and allowing said applicator carriage to move between said magazine and said applicator station along a single plane of motion; and an applicator carriage translating assembly operable to move said applicator carriage between said magazine and said applicator station.

2. The system of claim 1, further comprising a stop tab operable to hold a leading ring carrier in said magazine.

3. The system of claim 1, wherein said applicator carriage translating assembly comprises a four-bar linkage that is orthogonal to and between the applicator station and the magazine.

4. The system of claim 3, wherein said applicator carriage translating assembly comprises an oscillating axle to which the four-bar linkage is in mechanical communication.

5. The system of claim 4, further comprising a rotational actuator for said oscillating axle, said rotational actuator operable to oscillate said oscillating axle in a predetermined pattern.

6. The system of claim 4, wherein said applicator carriage translating assembly comprises an eccentric collar fixedly connected to said oscillating axle, such that said eccentric collar oscillates with said oscillating axle.

7. The system of claim 6, wherein said four bar linkage is in mechanical communication with said oscillating axle by connection to said eccentric collar, wherein said connection to said eccentric collar results in said four bar linkage creating an arcing path for said applicator carriage as it moves between said applicator station and said magazine.

8. The system of claim 1, wherein said applicator surface is a surface of an applicator plate that includes at least one vacuum coupling embedded therein operable to create a partial vacuum between the applicator plate and the ring carrier for aiding in picking a ring carrier from said magazine.

9. The system of claim 1, further comprising a grouped container advancement mechanism operable to advance said grouped containers from the grouping station to the applicator station while maintaining the pre-determined pattern of containers.

10. The system of claim 1, wherein said magazine includes a stopping mechanism and a biasing mechanism, wherein said biasing member advances said ring carriers toward a picking position to be grasped and removed by the applicator carriage and said stopping mechanism holds the ring carrier in the picking position in place until said applicator carriage is positioned over said magazine.

11. The system of claim 10, wherein said stopping mechanism is operable to be retracted from contact with said ring carrier in said picking position when said applicator carriage is positioned over said magazine.

12. A system for applied packaging to grouped containers, comprising:

a grouping station for organizing a plurality of containers into a pre-determined arrangement;

an applicator station for receiving said plurality of containers in said pre-determined arrangement;

an applicator carriage having an applicator surface for receiving a ring carrier, said applicator surface having apertures for receiving an upper aspect of each of said containers in said predetermined arrangement, pivoting retainer structures for holding said ring carrier in alignment with said applicator surface, the applicator carriage operable to fixedly apply said ring carrier to said upper aspects of said containers by a single axis vertical motion;

a magazine operable to contain a plurality of ring carriers in a vertical stack, said magazine positioned adjacent to said applicator station, and allowing said applicator carriage to move between said magazine and said applicator station along a single plane of motion; and a conveyor for delivering said containers into said grouping station having a container flow divider that organizes the containers into single-width rows of containers that are located upstream of the grouping station and that are funneled into pre-determined rows in said grouping station.

13. A system for applied packaging to grouped containers, comprising:

a grouping station for organizing a plurality of containers into a pre-determined arrangement;

an applicator station for receiving said plurality of containers in said pre-determined arrangement;

an applicator carriage having an applicator surface for receiving a ring carrier, said applicator surface having apertures for receiving an upper aspect of each of said containers in said predetermined arrangement, pivoting retainer structures for holding said ring carrier in alignment with said applicator surface, the applicator operable to fixedly apply said ring carrier to said upper aspects of said containers by a single axis vertical motion; and a container arresting mechanism operable to stop the advance of said containers into said grouping station.

14. The system of claim 13, further comprising an electronic controller in electronic communication with actuators for said container arresting mechanism.

* * * * *